US009945280B2

(12) United States Patent
Eichmueller et al.

(10) Patent No.: US 9,945,280 B2
(45) Date of Patent: Apr. 17, 2018

(54) EXHAUST GAS SYSTEM FOR AN INTERNAL COMBUSTION ENGINE AND METHOD FOR OPERATING THE EXHAUST GAS SYSTEM

(71) Applicant: Bayerische Motoren Werke Aktiengesellschaft, Munich (DE)

(72) Inventors: Christian Eichmueller, Munich (DE); Rainer Drees, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/874,520

(22) Filed: Oct. 5, 2015

(65) Prior Publication Data

US 2016/0024989 A1 Jan. 28, 2016

Related U.S. Application Data

(63) Continuation of application No. PCT/EP2014/058541, filed on Apr. 28, 2014.

(30) Foreign Application Priority Data

Jun. 5, 2013 (DE) ..... 10 2013 210 464

(51) Int. Cl.
*F02B 27/04* (2006.01)
*F01N 13/04* (2010.01)
(Continued)

(52) U.S. Cl.
CPC ..... *F01N 13/04* (2013.01); *F01N 1/023* (2013.01); *F01N 1/026* (2013.01); *F01N 1/166* (2013.01);
(Continued)

(58) Field of Classification Search
CPC ..... F01N 13/04; F01N 1/023; F01N 1/166; F01N 1/168
See application file for complete search history.

(56) References Cited

U.S. PATENT DOCUMENTS 4,926,636 A 5/1990 Tadokoro et al.
5,144,799 A 9/1992 Barth
(Continued)

FOREIGN PATENT DOCUMENTS

CN 101943046 A 1/2011
DE 689 09 965 T2 5/1994
(Continued)

OTHER PUBLICATIONS

Machine English translation of DE 102009032213 A1.*
(Continued)

*Primary Examiner* — Mark Laurenzi
*Assistant Examiner* — Jason Sheppard
(74) *Attorney, Agent, or Firm* — Crowell & Moring LLP

(57) ABSTRACT

An exhaust gas system is provided for an internal combustion engine having at least a first and a second cylinder. A first exhaust gas pipe is associated with the first cylinder and a second exhaust gas pipe is associated with the second cylinder. A first muffler is associated with the first exhaust gas pipe and a second muffler is associated with the second exhaust gas pipe. A first muffling pipe branches off from the first exhaust gas pipe upstream of a first shut-off element, and is fed through the first muffler and leads into the second exhaust gas pipe downstream of a second shut-off element. A second muffling pipe branches off from the second exhaust gas pipe upstream of the second shut-off element, and is fed through the second muffler and leads into the first exhaust gas pipe downstream of the first shut-off element.

7 Claims, 2 Drawing Sheets

(51) Int. Cl.

| | |
|---|---|
| ***F01N 13/02*** | (2010.01) |
| ***F01N 1/02*** | (2006.01) |
| ***F01N 1/16*** | (2006.01) |

(52) U.S. Cl.
CPC ..... *F01N 1/168* (2013.01); *F01N 13/02* (2013.01); *F01N 2240/36* (2013.01)

(56) References Cited

U.S. PATENT DOCUMENTS

| | | | | |
|---|---|---|---|---|
| 8,418,445 | B2 * | 4/2013 | Laube ..... | F01N 1/00 181/238 |
| 2010/0071992 | A1 | 3/2010 | Feng | |
| 2011/0000201 | A1 | 1/2011 | Laube et al. | |
| 2013/0008737 | A1 | 1/2013 | Mueller et al. | |

FOREIGN PATENT DOCUMENTS

| | | | |
|---|---|---|---|
| DE | 10 2009 032 213 | A1 | 1/2011 |
| DE | 20 2012 002 948 | U1 | 5/2012 |
| DE | 10 2011 051 690 | A1 | 1/2013 |
| EP | 2 049 777 | | 4/2009 |
| EP | 2 287 452 | A1 | 2/2011 |
| WO | WO 2008/017112 | A1 | 2/2008 |

OTHER PUBLICATIONS

International Search Report issued in PCT Application No. PCT/EP2014/058541 dated Jul. 7, 2014 with English translation (Six (6) pages).

German-language Search Report issued in counterpart German Application No. 10 2013 210 464.2 dated Aug. 26, 2013 with partial English translation (Ten (10) pages).

Chinese Office Action issued in counterpart Chinese Application No. 201480022113.X dated Feb. 17, 2017 with English-language translation (twelve (12) pages).

Chinese-language Office Action issued in counterpart Chinese Application No. 201480022113.X dated Aug. 7, 2017 with English translation (7 pages).

* cited by examiner

EXHAUST GAS SYSTEM FOR AN INTERNAL COMBUSTION ENGINE AND METHOD FOR OPERATING THE EXHAUST GAS SYSTEM

CROSS REFERENCE TO RELATED APPLICATIONS

This application is a continuation of PCT International Application No. PCT/EP2014/058541, filed Apr. 28, 2014, which claims priority under 35 U.S.C. § 119 from German Patent Application No. 10 2013 210 464.2, filed Jun. 5, 2013, the entire disclosures of which are herein expressly incorporated by reference.

This application contains subject matter related to U.S. application Ser. No. 14/874,523, entitled "Exhaust System for an Internal Combustion Engine and Method for Operating the Exhaust System" filed on Oct. 5, 2015.

BACKGROUND AND SUMMARY OF THE INVENTION

The invention relates to an exhaust gas system for an internal combustion engine and to methods for operating the exhaust gas system.

German laid-open specification DE 10 2009 032 213 A1, for example, discloses an exhaust gas system of an internal combustion engine, with a first exhaust tract assigned to a first group of cylinders of the internal combustion engine and with a second exhaust tract assigned to a second group of cylinders of the internal combustion engine. Each exhaust tract has a respective exhaust gas purification device and a first muffler arranged downstream of the respective exhaust gas purification device and also a second muffler arranged downstream of the respective first muffler, and an exhaust tailpipe arranged downstream of the respective second muffler.

A disadvantage of this known prior art is that the muffling resonator of the muffler is not variably adjustable.

Furthermore, the prior art has in general disclosed mufflers for exhaust gas systems which operate according to the absorption and/or reflection principle. The development of such a muffler generally means finding the best possible compromise between outlet noise (loudness downstream of the exhaust gas system tailpipe), exhaust gas backpressure and required muffler volume. In order to bypass such a compromise solution, mufflers are frequently designed with one or more movable closure elements or shut-off members, such as, for example, an exhaust gas flap, in order to permit different flow paths in the exhaust pipe of the muffler system. In the case of muffler systems for internal combustion engines, two, three or even four exhaust gas system tailpipes are frequently provided. In the muffler embodiments known from the prior art, the arrangement of the closure elements disadvantageously leads to exhaust gas no longer flowing through all of the exhaust gas system tailpipes or tailpipe branching elements, depending on the position of the closure element.

However, this prior art has the following disadvantages:

1) Customer irritation since exhaust gas does not emerge from all of the exhaust gas system tailpipes (visible at a lower outside temperature and by way of the different degree of soiling of the visible tailpipes);

2) High exhaust gas backpressure by means of a bottleneck in the exhaust gas system tailpipe;

3) Flow noises because of a bottleneck in the exhaust gas system tailpipe;

4) Thermal stress between cold and hot exhaust gas system tailpipe (risk of cracking);

5) Complicated routing of the muffling pipes in the muffler system;

6) High weight of the muffler system;

7) High production costs of the muffler system;

8) Flaps customarily can be switched separately or offset in time only to a limited extent; this results in a significant rise in exhaust gas backpressure in an exhaust tract.

It is the object of the present invention to avoid the abovementioned disadvantages and at the same time to introduce variability in the muffling properties of the muffler system.

This and other objects are achieved by providing an exhaust gas system, and method of operating same, for an internal combustion engine having at least one first and one second cylinder, wherein the first cylinder is assigned a first exhaust pipe and the second cylinder is assigned a second exhaust pipe, and wherein the first exhaust pipe is assigned a first muffler and the second exhaust pipe is assigned a second muffler. A first muffling pipe branches off from the first exhaust pipe upstream of a first shut-off member. The muffling pipe is guided through the first muffler and leads into the second exhaust pipe downstream of a second shut-off member. A second muffling pipe branches off from the second exhaust pipe upstream of the second shut-off member. The muffling pipe is guided through the second muffler and leads into the first exhaust pipe downstream of the first shut-off member.

All of the abovementioned problems are avoided by the configuration according to the invention of the exhaust gas system. The exhaust gas system has an advantageous construction with regard to the exhaust gas backpressure. By way of the construction according to the invention, one or both shut-off members can be closed, even simultaneously, without a substantial increase in the exhaust gas backpressure. In comparison to conventional exhaust gas systems, when shut-off members, such as, for example, exhaust gas flaps, are open, throttling (raising of the exhaust gas backpressure) is minimal or scarcely measurable since the entire volume of the exhaust pipe and muffling pipe as far as the end of the exhaust gas system is used. By way of a somewhat changed construction, the shut-off members can also be switched in a temporarily offset manner in order to improve a subjective audible impression during the switching phase. By way of the offset switching over of the two shut-off members, conspicuous acoustic jumps in level can be reduced in an advantageous manner.

With regard to power and dynamics (response behavior of the internal combustion engine), the exhaust gas backpressure, which is very low because of the configuration according to the invention, of the exhaust gas system has a highly positive effect. For slight acoustic adaptations, the volumes of the first muffler and of the second muffler can also be changed retrospectively. In addition, one or more possibly required resonators can be integrated in a simple manner into the exhaust gas system without a great outlay and while maintaining the symmetry.

Furthermore, the muffler can be constructed in a highly favorable manner by way of the symmetrical construction of the exhaust gas system.

A multiplicity of components of the exhaust gas system can be manufactured or used as favorable identical parts.

The muffler housing can be realized, for example, as a cost-effective wound muffler or in a shell construction. In the event of a realization as a wound muffler, the two side parts can be designed as identical parts. In the shell construction, the upper shell and the lower shell can each be designed as an identical part.

The exhaust pipes (FIG. 1, region a) can be produced and installed as identical components.

The Y branching elements from the exhaust pipes to the muffling pipes (FIG. 1, region b as far as/after the shut-off member) can be realized, for example, as a part molded by hydroforming. The latter can therefore be used as an identical part upstream and downstream of the shut-off member and on both sides of the mufflers.

The tailpipe branching elements are likewise to be as per the pipe branching (FIG. 1, region c). The tailpipe branching elements can likewise be designed as an identical part for both sides.

The muffling pipes with perforations and which are guided through the muffler (FIG. 1, region d) can likewise be realized as identical parts.

Should a resonator be required, the required partitions for both sides can likewise be realized as an identical part.

For the production, it is also possible to save on assembly tools because of the identical parts for the exhaust gas system. Depending on how the production of a manufacturer or supplier is realized, the identical assembly apparatus can be used for the preassembly of the Y branching elements and the shut-off members for both sides of the exhaust gas system.

All of the abovementined points lead to a significant reduction in the tool and production costs for the exhaust gas system according to the invention.

In addition, a possibly desirable lightweight construction can be realized significantly more simply by use of the large portion of identical parts and the reduction in variants of individual parts.

In a further development, the first and second mufflers may be arranged in a common housing. Further, the first muffling pipe may be assigned a first resonator chamber and the second muffling pipe may be assigned a second resonator chamber. Moreover, the first and second resonator chambers may be integrated into the common housing.

With the method for operating an exhaust gas system for an internal combustion engine according to the invention, minimum muffling is achieved by opening the first and second shut-off members.

With the method for operating an exhaust gas system for an internal combustion engine according to the invention, medium muffling is achieved by opening the first shut-off member and closing the second shut-off member.

With the method for operating an exhaust gas system for an internal combustion engine according to the invention, maximum muffling is achieved by closing the first and second shut-off members.

An exhaust gas system according to the invention and three methods for operating the exhaust gas system according to the invention are explained in more detail below in four figures.

Other objects, advantages and novel features of the present invention will become apparent from the following detailed description of one or more preferred embodiments when considered in conjunction with the accompanying drawings.

DETAILED DESCRIPTION OF THE DRAWINGS

The same reference numbers apply below for identical components in FIGS. 1 to 4.

Figure 1:
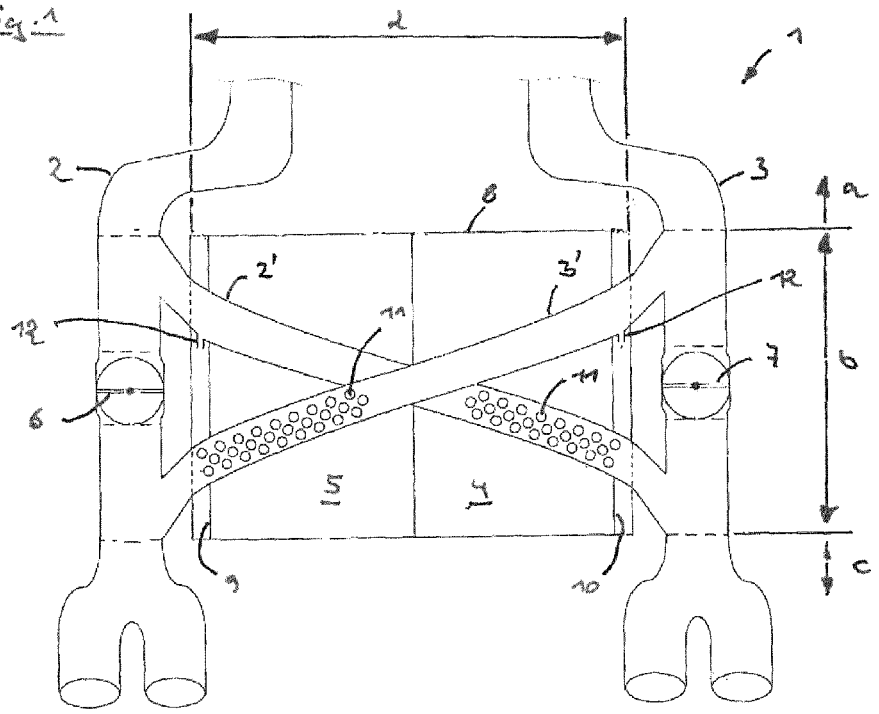
FIG. 1 is a schematic view of an exhaust gas system according to an embodiment of the invention.

FIG. 1 shows an end portion of an exhaust gas system 1 for an internal combustion engine (not illustrated), having at least one first and one second cylinder (likewise not illustrated). The first and the second cylinder are also representative of groups of cylinders of the internal combustion engine. The first cylinder is assigned a first exhaust pipe 2 and the second cylinder is assigned a second exhaust pipe 3. Furthermore, the first exhaust pipe 2 is assigned a first muffler 4 and the second exhaust pipe 3 is assigned a second muffler 5. According to the invention, a first muffling (damping) pipe 2' branches off from the first exhaust pipe 2 upstream of a first shut-off member 6. The muffling pipe is guided through the first muffler 4 and leads into the second exhaust pipe 3 downstream of a second shut-off member 7. A second muffling (damping) pipe 3' branches off from the second exhaust pipe 3 upstream of the second shut-off member 7. The muffling pipe is guided through the second muffler 5 and leads into the first exhaust pipe 2 downstream of the first shut-off member 6. Exhaust gas flow directions, which are illustrated by arrows, can be understood from FIGS. 2 to 4.

As is known from the prior art, the first muffling pipe 2' and the second muffling pipe 3' have perforations 11 in the volume of the first muffler 4 and in the volume of the second muffler 5 for outputting sound emissions into the mufflers 4, 5 for the frequency-selective damping of the sound pressure level.

In the present exemplary embodiment, the first and the second shut-off member 6, 7 is an exhaust gas flap, and, in other exemplary embodiments, may also be, for example, rollers.

In the present exemplary embodiment, the first and the second muffler 4, 5, for identical part reasons, are arranged in a common housing 8. In another exemplary embodiment, they can also have more expensive, separate housings.

Furthermore, in the present exemplary embodiment, the first muffling pipe 2' is assigned a first resonator chamber 9 and the second muffling pipe 3' is assigned a second resonator chamber 10. An acoustic coupling between the first muffling pipe 2' and the first resonator chamber 9 or between the second muffling pipe 3' and the second resonator chamber 10 takes place in each case by means of a Helmholtz resonator, which is numbered by 12. The first and the second resonator chamber 9, 10 are preferably integrated into the common housing 8. In another exemplary embodiment, the resonator chambers 9, 10 can also be provided in separate housings. In a further exemplary embodiment, the first and the second resonator chamber 9, 10 can also be designed as reflection chambers.

Owing to the symmetrical configuration of the exhaust gas system 1 according to the invention, the latter can be constructed very favorably in terms of cost. As illustrated above, a multiplicity of components can be produced and used favorably as identical parts.

The muffler housing 8 can be realized, for example, as a cost-effective wound muffler or in a shell construction. When realized as a wound muffler, the two side parts can be designed as identical parts. In the shell construction, the upper shell and the lower shell can each be designed as an identical part.

The exhaust pipes 2, 3 (FIG. 1, region a) can be produced and installed as identical components.

The Y branching elements from the exhaust pipes to the muffling pipes (FIG. 1, region b up to/after the shut-off members 6, 7) can be realized, for example, as a part molded by hydroforming. The latter can therefore be used as an identical part upstream and downstream of the shut-off members 6, 7 and on both sides of the mufflers 4, 5.

The tailpipe branching elements, not numbered separately, are likewise to be as per the pipe branching (FIG. 1, region c). Said tailpipe branching elements can likewise be designed as an identical part for both sides.

The muffling pipes 2', 3' with perforations and which are guided through the mufflers 4, 5 (FIG. 1, region d) can likewise be realized as identical parts.

Should a resonator 9, 10 be required, the necessary partitions for both sides can likewise be realized as an identical part.

It is also possible to save assembly tools for the production because of the identical parts for the exhaust gas system 1. Depending on how the production of a manufacturer or supplier is realized, the identical assembly apparatus can be used for the preassembly of the Y branching elements and the shut-off members 6, 7 for both sides of the exhaust gas system 1. This likewise results in a significant reduction of tool costs.

Figure 2:
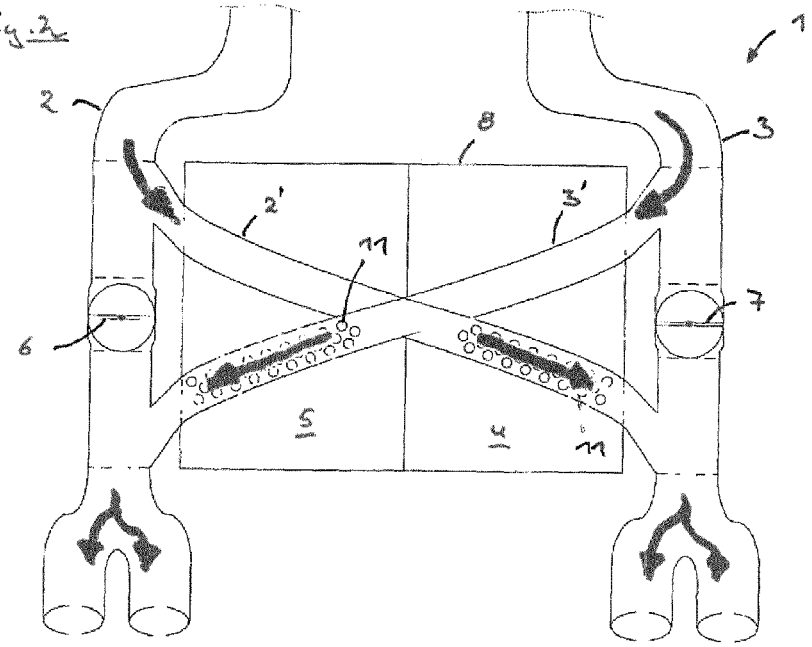
FIG. 2 is a schematic view of the exhaust gas system according to the embodiment of the invention with two closed shut-off members.
Figure 3:
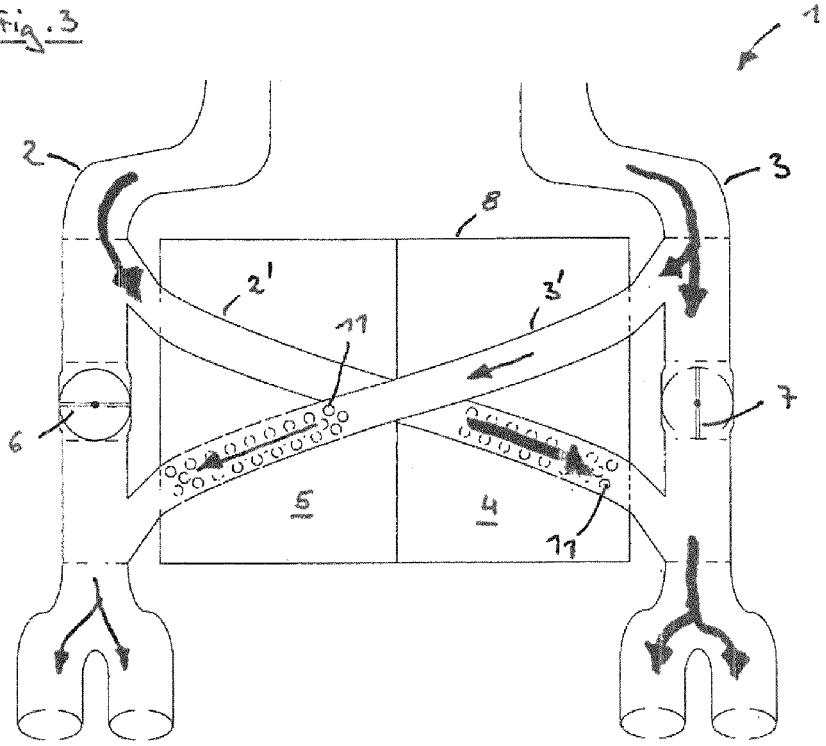
FIG. 3 is a schematic view of the exhaust gas system according to the embodiment of the invention with one closed and one open shut-off member.
Figure 4:
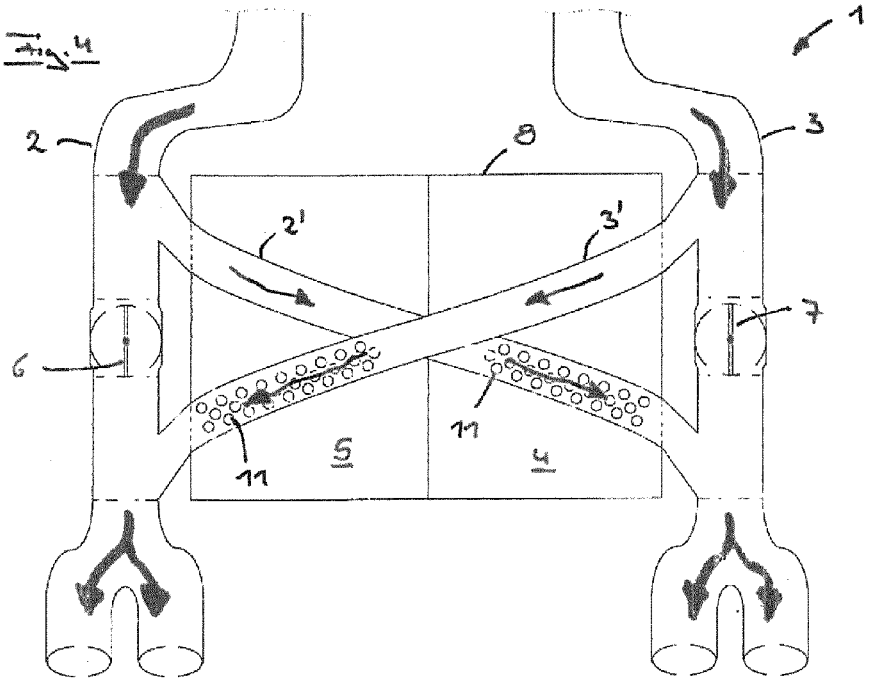
FIG. 4 is a schematic view of the exhaust gas system according to the embodiment of the invention with two open shut-off members.

FIGS. 2 to 4 show the same exhaust gas system as FIG. 1, but without the first and the second resonator chamber 9, 10, which can also be designed as reflection chambers.

FIG. 2 shows the exhaust gas system 1 with a setting for a first operating method, wherein the first and second shut-off members 6, 7 are closed. By way of this setting, maximum muffling for the exhaust gas system 1 is achieved. The exhaust gas flow direction is indicated by arrows.

FIG. 3 shows the exhaust gas system 1 with a setting for a second operating method, wherein the first shut-off member 6 is closed and the second shut-off member 7 is open. By way of this setting, medium muffling for the exhaust gas system 1 is achieved. The main exhaust gas flow is illustrated by thick arrows, and a weakened exhaust gas flow is illustrated by thin arrows.

FIG. 4 shows the exhaust gas system 1 with a setting for a third operating method, wherein the first and the second shut-off members 6, 7 are open. By way of this setting, minimum muffling for the exhaust gas system 1 is achieved. The main exhaust gas flow is in turn illustrated by thick arrows, and a weakened exhaust gas flow is illustrated by thin arrows.

The exhaust gas system 1 according to the invention has a very advantageous construction with regard to the exhaust gas backpressure. By means of the construction according to the invention, one or both shut-off members 6, 7 can be closed, even simultaneously, without a substantial increase in the exhaust gas backpressure. In comparison to conventional exhaust gas systems, when the shut-off members 6, 7, such as, for example, exhaust gas flaps, are open, throttling (raising of the exhaust gas backpressure) is minimal or scarcely measurable since the entire volume of the exhaust pipe and muffling pipe as far as the end of the exhaust gas system 1 is used. By means of a somewhat changed construction, the shut-off members 6, 7 can also be switched in a temporally offset manner in order to improve a subjective audible impression during the switching phase. By means of the offset switching over of the two shut-off members 6, 7, conspicuous acoustic level jumps can be reduced in an advantageous manner.

With regard to power and dynamics (response behavior of the internal combustion engine), the exhaust gas backpressure, which is very low because of the configuration according to the invention, of the exhaust gas system 1 has a highly positive effect. For slight acoustic adaptations, the volumes of the first muffler 4 and of the second muffler 5 can also be changed retrospectively. In addition, one or more possibly necessary resonator chambers 9, 10, also designed as reflection chambers, can be integrated in a simple manner into the exhaust gas system 1 without a large outlay and while maintaining the symmetry.

LIST OF REFERENCE SIGNS

1. Exhaust gas system
2. First exhaust pipe
2'. First muffling pipe
3. Second exhaust pipe
3'. Second muffling pipe
4. First muffler
5. Second muffler
6. First shut-off member
7. Second shut-off member
8. Housing
9. First resonator chamber/reflection chamber
10. Second resonator chamber/reflection chamber
11. Perforation
12. Helmholtz resonator
a. Exhaust pipe
b. Branching part
c. Tailpipe branching element
d. Muffling pipe The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust gas system for an internal combustion engine having at least a first and a second cylinder, the exhaust gas system comprising:

a first exhaust pipe assigned to the first cylinder;

a second exhaust pipe assigned to the second cylinder;

a first muffler assigned to the first exhaust pipe;

a second muffler assigned to the second exhaust pipe;

a first muffling pipe branching off from the first exhaust pipe upstream of a first shut-off member;

a second muffling pipe branching off from the second exhaust pipe upstream of a second shut-off member, wherein the first muffling pipe is guided through the first muffler and leads into the second exhaust pipe downstream of the second shut-off member, and the second muffling pipe is guided through the second muffler and leads into the first exhaust pipe downstream of the first shut-off member, the first exhaust pipe and the second exhaust pipe are devoid of any perforations, the first muffling pipe has perforations in a region that spans through the first muffler, the second muffling pipe has perforations in a region that spans through the second muffler, a first resonator chamber assigned to the first muffling pipe, a second resonator chamber assigned to the second muffling pipe, and a Helmholtz resonator provides acoustic coupling between at least one of the first muffling pipe and the first resonator chamber and between the second muffling pipe and the second resonator chamber.

2. The exhaust gas system according to claim 1, further comprising: a common housing in which the first and second mufflers are arranged.

3. The exhaust gas system according to claim 1, wherein the first and second resonator chambers are integrated in the common housing.

4. A method for operating an exhaust gas system for an internal combustion engine having at least a first and a second cylinder, the method comprising the acts of:

providing a first exhaust pipe assigned to the first cylinder; providing a second exhaust pipe assigned to the second cylinder;

providing a first muffler assigned to the first exhaust pipe; providing a second muffler assigned to the second exhaust pipe; providing a first muffling pipe branching off from the first exhaust pipe upstream of a first shut-off member;

providing a second muffling pipe branching off from the second exhaust pipe upstream of a second shut-off member, wherein the first muffling pipe is guided through the first muffler and leads into the second exhaust pipe downstream of the second shut-off member, the second muffling pipe is guided through the second muffler and leads into the first exhaust pipe downstream of the first shut-off member; and opening the first and second shut-off members for minimal muffling, the first exhaust pipe and the second exhaust pipe are devoid of any perforations, the first muffling pipe has perforations in a region that spans through the first muffler, the second muffling pipe has perforations in a region that spans through the second muffler, a first resonator chamber assigned to the first muffling pipe, a second resonator chamber assigned to the second muffling pipe, and a Helmholtz resonator provides acoustic coupling between at least one of the first muffling pipe and the first resonator chamber and between the second muffling pipe and the second resonator chamber.

5. The method according to claim 4, further comprising the act of: opening the first shut-off member and closing the second shut-off member for medium muffling.

6. The method according to claim 5, further comprising the act of: closing the first and the second shut-off members for maximum muffling.

7. The method according to claim 4, further comprising the act of: closing the first and the second shut-off members for maximum muffling.

* * * * *